US006695754B1

(12) United States Patent
Gazzolo

(10) Patent No.: US 6,695,754 B1
(45) Date of Patent: Feb. 24, 2004

(54) EXERCISE DEVICE FOR SUPPORTING AT LEAST ONE ANKLE DURING A PHYSICAL EXERCISE

(76) Inventor: David M. Gazzolo, 1027 W. Vernon Park Pl., Chicago, IL (US) 60607

( * ) Notice: Subject to any disclaimer, the term of this patent is extended or adjusted under 35 U.S.C. 154(b) by 0 days.

(21) Appl. No.: 10/329,737

(22) Filed: Dec. 26, 2002

(51) Int. Cl.[7] ..... A63B 26/00; A63B 71/00
(52) U.S. Cl. ..... 482/141; 482/62; 482/69
(58) Field of Search ..... 482/141, 51, 143, 482/144, 62, 69, 148, 66, 68

(56) References Cited

U.S. PATENT DOCUMENTS 621,098 A 3/1899 Kelly
3,532,356 A 10/1970 Lillibridge
3,895,795 A 7/1975 Merz
4,126,308 A 11/1978 Crumley
4,826,151 A 5/1989 Nuredin
5,004,229 A 4/1991 Lind
5,176,595 A 1/1993 Lind

*Primary Examiner*—Nicholas D. Lucchesi
*Assistant Examiner*—L Amerson
(74) *Attorney, Agent, or Firm*—Michael R. McKenna

(57) ABSTRACT

An exercise device for supporting one or both ankles during a pushup exercise routine in which the ankle holder is pivotally disposed on an elongated upright stand and the pivoting ankle holders are biased, preferably by weight distribution, so that the ankle receiving surface of each ankle holder is upwardly disposed and ready to receive an ankle.

24 Claims, 1 Drawing Sheet

EXERCISE DEVICE FOR SUPPORTING AT LEAST ONE ANKLE DURING A PHYSICAL EXERCISE

BACKGROUND OF THE INVENTION

This invention relates to an exercise device for supporting one or both ankles during a pushup exercise routine.

Ankle supporting devises include U.S. Pat. No. 621,098, issued to Kelly in 1899, teach a foot or leg rest which is rigid relative to its framework and although the Kelly framework rocks, it distinct center of rotation causes the actual rest to move at variance to an exerciser using the device; and U.S. Pat. No. 4,826,151, issued to Nuredin in 1989 for a pushup and hand walking exerciser, which contains a rigid ankle support. Such devices either do not accommodate a user's movement during a pushup exercise or they overcompensate by excessive movement relative to the user.

To alleviate this problem, and others which will become apparent from the disclosure which follows, the present invention conveniently teaches an exercise device for supporting one or both ankles during a pushup exercise routine in which the ankle holder itself is pivotally disposed on an elongated upright stand. Preferably the pivoting ankle holders are biased by the appropriate distribution of weight, so that the ankle receiving surface of each ankle holder is upwardly disposed and ready to receive an ankle.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that are less adapted for comfortable and convenient use, the invention relates to an exercise device for supporting one or both ankles during a pushup exercise routine in which the ankle holder is pivotally disposed on an elongated upright stand and the pivoting ankle holders are biased, preferably by weight distribution so that the ankle receiving surface of each ankle holder is upwardly disposed and ready to receive an ankle.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to an exercise device for supporting at least one ankle during a physical exercise routine comprising an ankle holder, means for pivotally supporting the ankle holder, an elongated stand having means for attaching the means for pivotally supporting, and means for maintaining the elongated stand in an upright position, in which an exerciser can position the at least one ankle along a first length of the ankle holder which can pivot with the at least one ankle as the exerciser performs a pushup exercise routine. The ankle holder preferably has a pad member having a pad with an upwardly biased exterior surface for receiving an ankle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
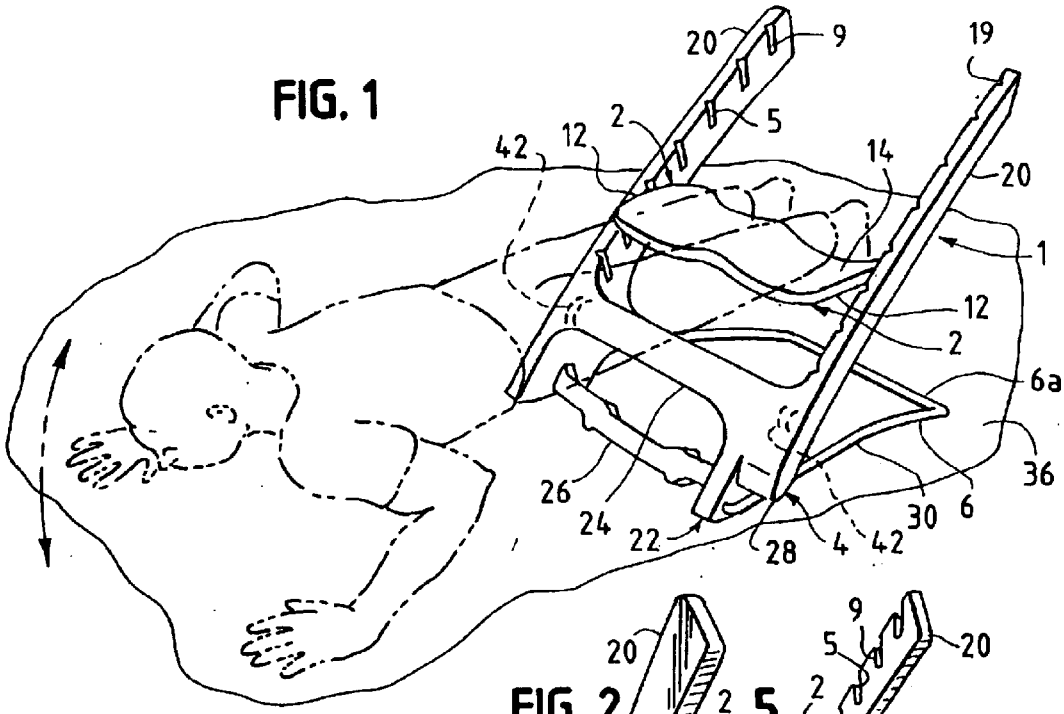
FIG. 1 is a perspective view of an operative position of the exercise device for supporting at least one ankle with an exerciser engaged in a physical exercise routine shown in phantom.

The preferred embodiments depicted in the drawing comprise an exercise device for supporting at least one ankle during a physical exercise routine comprising an ankle holder, means for pivotally supporting the ankle holder, an elongated stand having means for attaching the means for pivotally supporting, and means for maintaining the elongated stand in an upright position, in which an exerciser can position the at least one ankle along a first length of the ankle holder which can pivot with the at least one ankle as the exerciser performs a pushup exercise routine. The ankle holder preferably has a pad member having a pad with an upwardly biased exterior surface for receiving an ankle.

Without departing from the generality of the invention disclosed herein and without limiting the scope of the invention, the discussion that follows, will refer to the invention as depicted in the drawing.

The preferred embodiments of the apparatus depicted in the drawing comprise an exercise device 1 for supporting at least one ankle during a physical exercise routine comprising an ankle holder 2, means for pivotally supporting 3 the ankle holder, an elongated stand 4 having means for attaching 5 the means for pivotally supporting, and means for maintaining 6 the elongated stand in an upright position. As can be appreciated, an exerciser (shown in phantom in FIG. 1) can position the at least one ankle along a first length 10 of the ankle holder 2 which can pivot with the at least one ankle as the exerciser performs a physical exercise routine. The ankle holder contemplated may a single integrated holder for two ankles or two similar side by side individual ankle holders. As shown in FIGS. 1–3 and 5, the ankle holder 2 may comprise a pad member 12 having a pad 14 with an exterior surface 16 adapted to receive an ankle.

Figure 5:
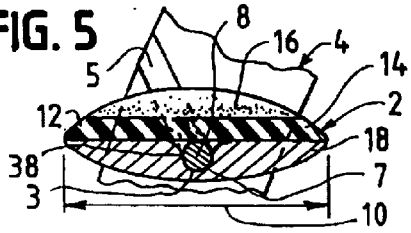
FIG. 5 is a cross-sectional view of the ankle pad and arm taken along the line 5—5 of FIG. 2 showing the weighted portion of the pad which upwardly biases the exterior surface adapted to receive an ankle.

Furthermore, the pad member 12 will preferably have its weight distributed about the means for pivotally supporting, so that the exterior surface 16 of the pad 14 is biased toward an upward disposition. A distinct weight 18 can be disposed opposite the exterior surface as shown in FIG. 5.

Referring again to FIG. 5, the means for pivotally supporting 3 may comprise an elongated spindle 8 about which a pad member 12 can freely rotate. The elongated spindle 8 is shown disposed in a generally horizontal plane and transverse to the first length 10 of the ankle in the ankle holder 2.

Figure 6:
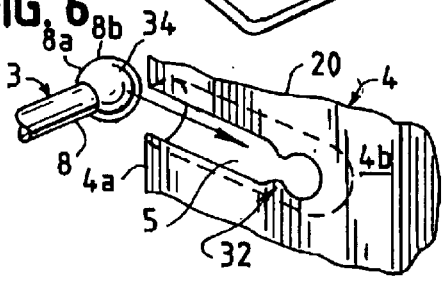
FIG. 6 is a fragmentary perspective view of one of a slot and a complementary slot and a preferred bulbous end of the spindle.

As best shown in FIG. 6, the elongated spindle 8 may have a first end 8*a* and a second end 8*b* with each of the first end and the second end operably connected to the means for attaching 5. Moreover, the means for attaching the elongated stand can comprise at least one slot 9 and at least one complementary slot 19. The at least one slot can be adapted to receive one of the first end and the second end of the elongated spindle, and the at least one complementary slot being adapted to receive the other one of the first end and the second end of the elongated spindle as the elongated.

Figure 3:
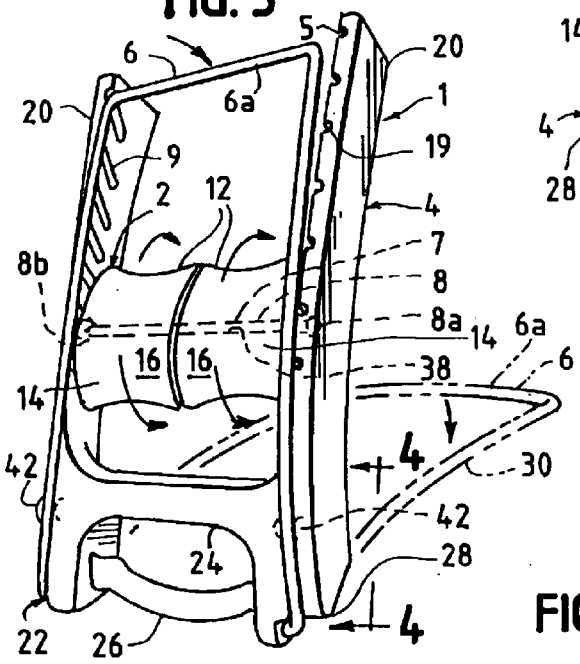
FIG. 3 is a perspective view of the exercise device for supporting at least one ankle of the present invention showing a collapsed position and illustration of the pivoting motion of the ankle pads, and with the means for maintaining the elongated stand in an upright position shown in phantom.

In a preferred embodiment of the exercise device for supporting at least one ankle during a physical exercise routine, the elongated stand may comprise a pair of parallel arms 20, each of the arms extending from a central frame 22. Referring to FIG. 3, the central frame may comprise a strut 24 disposed between the pair of parallel arms. Additionally, the central frame 22 may have a handle 26 for ease in carrying the exercise device.

The central frame 22 may also have a shoulder 28 proximate each of the arms 20. Preferably, the means for maintaining 6 will comprise at least one leg 30 and it may comprise at least one rotatable leg. As shown in FIG. 3, the means for maintaining 6 may be rotatable relative to the elongated stand 4 between a collapsed position in which the means for maintaining is generally in line with the pair of parallel arms and an operative position in which further rotation of the means for maintaining is blocked by the shoulder of the elongated stand (shown in phantom). In this way, the elongated stand can be maintained in an upright position with the ankle holder disposed at a preselected height above a floor as the means for maintaining is disposed in the operative position. In the collapsed position, a distal end of the means for maintaining is disposed adjacent to at least one of the pair of parallel arms, and in the operative position, the means for maintaining is disposed in a rotated position in which the distal end of the means for maintaining is disposed at a spaced distance from the at least one of the pair of parallel arms, whereby, as the means for maintaining is disposed the operative position along a floor, the elongated stand is maintained in an upright position with the ankle holder disposed at a preselected height above the floor.

The exercise device for supporting at least one ankle during a physical exercise routine of the present invention may have each of the at least one slot 9 and each of the at least one complementary slot 19 comprising a snap-fitting 32 for engaging an end of the spindle 8, as shown in FIG. 6. Additionally, the elongated spindle 8 preferably has a generally uniform cross-sectional dimension excepting the first end and the second end which each have a bulbous shape 34 with a maximum transverse dimension that is less by a predetermined amount than the generally uniform cross-sectional dimension of the elongated spindle 8, and wherein each at least one slot 9 and each at least one complementary slot 19 are comprised of an elongated recess with an opening with a first part of said opening commencing at a first surface 4*a* of the elongated stand 4 and extending along an adjacent surface 4*b* with a first part of the opening proximate the first surface having a minimum transverse dimension that is greater than the maximum transverse dimension of the bulbous shape of each of the first end and the second end of the elongated spindle, and a second part of the opening that extends along the adjacent surface with a transverse dimension that is less than the maximum transverse dimension of the bulbous shape of first end and the second end of the elongated spindle and that is greater by a predetermined amount than the generally uniform cross-sectional dimension of the elongated spindle. As a result, a bulbous end of the elongated spindle can be inserted into the first part of said opening with the generally uniform cross-sectional dimension of the elongated spindle extending through the second part of the opening and the bulbous end of the elongated spindle limitedly secured therein.

Figure 4:
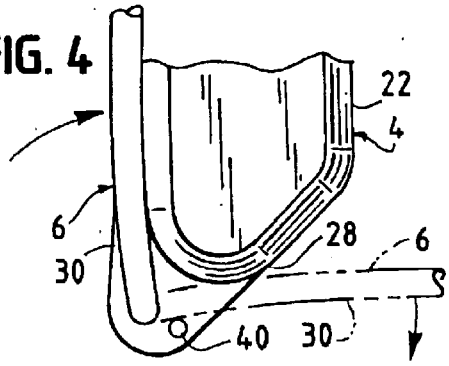
FIG. 4 is a partial side elevation view taken along the line 4—4 of FIG. 3 showing the relationship between the means for maintaining the elongated stand in an upright position and the shoulder of the frame which limits the rotation of the means for maintaining the elongated stand in an upright position.

Additionally, the exercise device for supporting at least one ankle during a physical exercise routine of the present invention may provide an elongated stand with means for securing 40 the means for maintaining in an operative position, as shown in FIG. 4, and means for fastening 42 the means for maintaining in an collapsed position shown in FIGS. 1 and 3. The means for securing and the means for fastening each comprise a protuberance operatively disposed in the path of the means for maintaining.

Moreover, the means for maintaining may be rotatable relative to the elongated stand between a collapsed position and an operative position, as shown in FIG. 3. In the collapsed position, a distal end of the means for maintaining is disposed adjacent to at least one of the pair of parallel arms, and in the operative position, the means for maintaining is disposed in a rotated position in which the distal end 6*a* of the means for maintaining 6 is disposed at a spaced distance from the at least one of the pair of parallel arms, and as the means for maintaining is disposed in the operative position along a floor, the elongated stand is maintained in an upright position with the ankle holder disposed at a preselected height above the floor. Said height being predetermined by the users placement of the elongated spindle in one of a plurality of pairs of slots and complementary slots disposed in a common horizontal plane.

In the operative position, a proximal section of the means for maintaining 6 preferably is disposed adjacent to the shoulder 28 which limits further rotation of the means for maintaining 6, as shown in FIG. 6.

In the preferred embodiment shown in FIG. 3, the means for maintaining 6 is rotatable relative to the elongated stand 4 between a collapsed position in which the means for maintaining is adjacent to at least one of the pair of parallel arms and an operative position in which rotational movement of the means for maintaining 6 is blocked by the shoulder 28 of the elongated stand 8. Thus the elongated stand 8 can be maintained in an upright position, as shown in FIG. 1, with the ankle holder 2 disposed at a preselected height above a floor 36 as the means for maintaining is disposed in the operative position.

In another preferred embodiment of the exercise device 1 for supporting at least one ankle during a physical exercise routine, an ankle holder 2 having a pad member 12 having a pad 14 with an exterior surface 16 adapted to receive an ankle, means for supporting 7 the ankle holder 2, an elongated stand 4 having means for attaching 5 the means for supporting the elongated stand 4 having a pair of parallel arms, each of the arms 20 extending from a central frame 22, the central frame having a shoulder 28 proximate each of the arms 20, and means for maintaining 6 the elongated stand 4 in an upright position are taught with the means for maintaining having at least one leg 30. As described, an exerciser can position the at least one ankle along a first length of the ankle holder as the exerciser performs a physical exercise routine. Furthermore, the means for maintaining comprises at least one rotatable leg.

Additionally, the means for maintaining may be rotatable relative to the elongated stand 4 between a collapsed position in which the means for maintaining 6 is generally in line with the pair of parallel arms 20 and an operative position in which further rotation of the means for maintaining 6 is blocked by the shoulder 28 of the elongated stand. The elongated stand, it will be seen can be maintained in an upright position with the ankle holder disposed at a preselected height above a floor as the means for maintaining is disposed in the operative position.

Furthermore, in the exercise device for supporting at least one ankle during a physical exercise routine of this important invention, the means for maintaining may be rotatable relative to the elongated stand between a collapsed position in which the means for maintaining is adjacent to at least one of the pair of parallel arms and an operative position in which rotational movement of the means for maintaining is blocked by the shoulder of the elongated stand, whereby, the elongated stand can be maintained in an upright position with the ankle holder disposed at a preselected height above a floor as the means for maintaining is disposed in the operative position.

In the collapsed position, a distal end of the means for maintaining is disposed adjacent to at least one of the pair of parallel arms, and in the operative position, the means for maintaining is disposed in a rotated position in which the distal end of the means for maintaining is disposed at a spaced distance from the at least one of the pair of parallel arms. In this way, as the means for maintaining is disposed the operative position along a floor, the elongated stand is maintained in an upright position with the ankle holder disposed at a preselected height above the floor.

Figure 2:
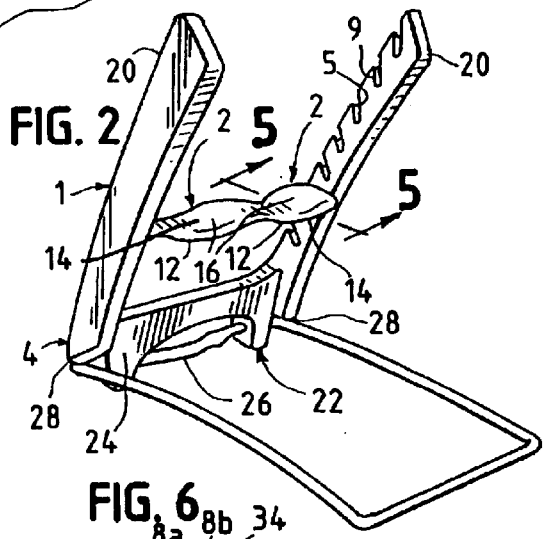
FIG. 2 is another perspective view of an operative position of the exercise device for supporting at least one ankle.

In another preferred embodiment of the exercise device 1 for supporting at least one ankle during a physical exercise routine of the present invention an ankle holder 2, means for non-rigidly supporting 38 the ankle holder 2, an elongated stand 4 having means for attaching 5 the means for non-rigidly supporting 38, and means for maintaining the elongated stand in an upright position are disclosed. An exerciser can position the at least one ankle on the ankle holder which can rotate with the at least one ankle as the exerciser performs a physical exercise routine. As shown in FIGS. 1–3, the elongated stand may resemble a yoke.

The unique design allows this lightweight exercise device to be easily closed into a collapsed position so that it can be stored, under a bed for example, when not in use. The device may be constructed with any material suited to the purpose, such as wood, metal, plastic, or the like. Preferably it can be readily made from a lightweight hardened plastic for the frame and ankle holder surfaces, various metals for the spindle, and an aluminum hollow rod material for the means for maintaining the stand.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise device for supporting at least one ankle during a physical exercise routine comprising:

a. an ankle holder;

b. means for pivotally supporting the ankle holder;

c. an elongated stand having means for attaching the means for pivotally supporting; and d. means for maintaining the elongated stand in an upright position, whereby, an exerciser can position the at least one ankle along a first length of the ankle holder which can pivot with the at least one ankle as the exerciser performs a pushup exercise routine.

2. The exercise device for supporting at least one ankle during a physical exercise routine of claim 1, wherein the ankle holder comprises a pad member having a pad with an exterior surface adapted to receive an ankle.

3. The exercise device for supporting at least one ankle during a physical exercise routine of claim 2, wherein the pad member has its weight distributed in such a way about the means for pivotally supporting that the exterior surface of the pad is biased toward an upward disposition.

4. The exercise device for supporting at least one ankle during a physical exercise routine of claim 1, wherein the means for pivotally supporting comprises an elongated spindle about which a pad member can freely rotate, said elongated spindle being disposed in a generally horizontal plane and transverse to the first length of the ankle.

5. The exercise device for supporting at least one ankle during a physical exercise routine of claim 4, wherein the elongated spindle has a first end and a second end, and each of said first end and said second end is operably connected to the means for attaching.

6. The exercise device for supporting at least one ankle during a physical exercise routine of claim 5, wherein the means for attaching of the elongated stand comprises at least one slot and at least one complementary slot, the at least one slot being adapted to receive one of the first end and the second end of the elongated spindle, and the at least one complementary slot being adapted to receive the other one of first end and the second end of the elongated spindle as said elongated.

7. The exercise device for supporting at least one ankle during a physical exercise routine of claim 6, wherein each at least one slot and each at least one complementary slot are comprise a snap-fitting for engaging an end of the spindle.

8. The exercise device for supporting at least one ankle during a physical exercise routine of claim 6, wherein the elongated spindle has a generally uniform cross-sectional dimension excepting the first end and the second end which each have a bulbous shape with a maximum transverse dimension that is less by a predetermined amount than the generally uniform cross-sectional dimension of the elongated spindle, and wherein each at least one slot and each at least one complementary slot are comprise an elongated recess with an opening with a first part of said opening commencing at a first surface of the elongated stand and extending along an adjacent surface with a first part of the opening proximate the first surface having a minimum transverse dimension that is greater than the maximum transverse dimension of the bulbous shape of each of the first end and the second end of the elongated spindle, and a second part of the opening that extends along the adjacent surface with a transverse dimension that is less than the maximum transverse dimension of the bulbous shape of first end and the second end of the elongated spindle and that is greater by a predetermined amount than the generally uniform cross-sectional dimension of the elongated spindle, whereby, a bulbous end of the elongated spindle can be inserted into the first part of said opening with the generally uniform cross-sectional dimension of the elongated spindle extending through the second part of the opening and the bulbous end of the elongated spindle limitedly secured therein.

9. The exercise device for supporting at least one ankle during a physical exercise routine of claim 1, wherein the elongated stand comprises means for securing the means for maintaining in an operative position and means for fastening the means for maintaining in an collapsed position.

10. The exercise device for supporting at least one ankle during a physical exercise routine of claim 9, wherein the means for securing and the means for fastening each comprise a protuberance operatively disposed in the path of the means for maintaining.

11. The exercise device for supporting at least one ankle during a physical exercise routine of claim 1, wherein the elongated stand comprises a pair of parallel arms, each of said arms extending from a central frame.

12. The exercise device for supporting at least one ankle during a physical exercise routine of claim 11, wherein the central frame comprises a strut disposed between the pair of parallel arms.

13. The exercise device for supporting at least one ankle during a physical exercise routine of claim 11, wherein the central frame has a handle for ease in carrying the exercise device.

14. The exercise device for supporting at least one ankle during a physical exercise routine of claim 11, wherein the central frame has a shoulder proximate each of the arms.

15. The exercise device for supporting at least one ankle during a physical exercise routine of claim 14, wherein the means for maintaining comprises at least one leg.

16. The exercise device for supporting at least one ankle during a physical exercise routine of claim 14, wherein the means for maintaining comprises at least one rotatable leg.

17. The exercise device for supporting at least one ankle during a physical exercise routine of claim 14, wherein the means for maintaining is rotatable relative to the elongated stand between a collapsed position and an operative position, in the collapsed position, a distal end of the means for maintaining is disposed adjacent to at least one of the pair of parallel arms, and in the operative position, the means for maintaining is disposed in a rotated position in which the distal end of the means for maintaining is disposed at a spaced distance from the at least one of the pair of parallel arms, whereby, as the means for maintaining is disposed the operative position along a floor, the elongated stand is maintained in an upright position with the ankle holder disposed at a preselected height above the floor.

18. The exercise device for supporting at least one ankle during a physical exercise routine of claim 17, wherein in the operative position, a proximal section of the means for maintaining is disposed adjacent to the shoulder which limits further rotation of the means for maintaining.

19. An exercise device for supporting at least one ankle during a physical exercise routine comprising:

a. an ankle holder having a pad member having a pad with an exterior surface adapted to receive an ankle;

b. means for supporting the ankle holder;

c. an elongated stand having means for attaching the means for supporting said elongated stand having a pair of parallel arms, each of said arms extending from a central frame said central frame having a shoulder proximate each of the arms; and d. means for maintaining the elongated stand in an upright position, said means for maintaining having at least one leg, whereby, an exerciser can position the at least one ankle along a first length of the ankle holder as the exerciser performs a pushup exercise routine.

20. The exercise device for supporting at least one ankle during a physical exercise routine of claim 19, wherein the means for maintaining comprises at least one rotatable leg.

21. The exercise device for supporting at least one ankle during a physical exercise routine of claim 19, wherein the means for maintaining is rotatable relative to the elongated stand between a collapsed position and an operative position, in the collapsed position, a distal end of the means for maintaining is disposed adjacent to at least one of the pair of parallel arms, and in the operative position, the means for maintaining is disposed in a rotated position in which the distal end of the means for maintaining is disposed at a spaced distance from the at least one of the pair of parallel arms, whereby, as the means for maintaining is disposed the operative position along a floor, the elongated stand is maintained in an upright position with the ankle holder disposed at a preselected height above the floor.

22. The exercise device for supporting at least one ankle during a physical exercise routine of claim 19, wherein the means for maintaining is rotatable relative to the elongated stand between a collapsed position in which the means for maintaining is adjacent to at least one of the pair of parallel arms and an operative position in which rotational movement of the means for maintaining is blocked by the shoulder of the elongated stand, whereby, the elongated stand is maintained in an upright position with the ankle holder disposed at a preselected height above a floor as the means for maintaining is disposed in the operative position.

23. An exercise device for supporting at least one ankle during a physical exercise routine comprising:

a. an ankle holder;

b. means for non-rigidly supporting the ankle holder;

c. an elongated stand having means for attaching the means for non-rigidly supporting; and d. means for maintaining the elongated stand in an upright position, whereby, an exerciser can position the at least one ankle on the ankle holder which can rotate with the at least one ankle as the exerciser performs a pushup exercise routine.

24. The exercise device for supporting at least one ankle during a physical exercise routine of claim 23, wherein the elongated stand is in the shape of a yoke.

* * * * *